US005122182A

United States Patent [19]

Dorfman et al.

[11] Patent Number: 5,122,182

[45] Date of Patent: Jun. 16, 1992

[54] COMPOSITE THERMAL SPRAY POWDER OF METAL AND NON-METAL

[75] Inventors: Mitch R. Dorfman, Smithtown; Burton A. Kushner, Old Bethpage; Anthony J. Rotolico, Hauppauge; Brian A. DelRe, Massapegua; Edward R. Novinski, E. Williston, all of N.Y.

[73] Assignee: The Perkin-Elmer Corporation, Norwalk, Conn.

[21] Appl. No.: 517,791

[22] Filed: May 2, 1990

[51] Int. Cl.[5] ..... B22F 1/00

[52] U.S. Cl. ..... 75/252; 75/254; 428/323; 428/328; 428/331; 428/402; 428/403

[58] Field of Search ..... 428/402, 323, 328, 331, 428/403; 75/252, 254

[56] References Cited

U.S. PATENT DOCUMENTS

| | | | |
|---|---|---|---|
| 3,617,358 | 11/1971 | Dittrich | 75/252 |
| 3,655,425 | 4/1972 | Longo et al. | 428/403 |
| 3,723,165 | 3/1973 | Longo et al. | 75/252 |
| 3,909,241 | 9/1975 | Cheney et al. | 75/0.5 BB |
| 4,118,527 | 10/1978 | Patel | 75/252 |
| 4,189,317 | 2/1980 | Patel | 75/252 |
| 4,190,443 | 2/1980 | Patel | 75/252 |
| 4,191,565 | 3/1980 | Patel | 75/252 |
| 4,263,353 | 4/1981 | Patel | 75/252 |
| 4,291,089 | 9/1981 | Adamovic | 428/325 |
| 4,578,114 | 3/1986 | Rangaswamy et al. | 75/252 |
| 4,593,007 | 6/1986 | Novinski | 428/403 |
| 4,705,560 | 11/1987 | Kemp, Jr. et al. | 75/0.5 BB |
| 4,773,928 | 9/1988 | Houck et al. | 75/0.5 R |

FOREIGN PATENT DOCUMENTS

| | | |
|---|---|---|
| 244343 | 4/1987 | European Pat. Off. . |
| 1811196 | 6/1970 | Fed. Rep. of Germany . |

*Primary Examiner*—Paul J. Thibodeau
*Assistant Examiner*—Mark Forman
*Attorney, Agent, or Firm*—H. S. Ingham; E. T. Grimes

[57] ABSTRACT

Two constituent powders of a powder blend for thermal spraying are in the form of composite particles containing subparticles of nickel alloy and benoite for clearance control coatings. The composite particles are formed by spray drying. In one embodiment the volume percentage of metal in one constituent powder is at least 25% greater than in the other powder. In another embodiment the difference is about 10% by volume, and the alloy rich constituent has alloy subparticles sufficiently large to act as core particles to which the finer subparticles of bentonite are bonded.

16 Claims, No Drawings

COMPOSITE THERMAL SPRAY POWDER OF METAL AND NON-METAL

This invention relates to powders for thermal spraying and particularly to a composite powder of a metal and a non-metal.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U. S. Standard screen size (149 microns) and about 2 microns.

A thermal spray gun normally utilizes a combustion or plasma flame to produce the heat for melting of the powder particles. Other heating means may be used as well, such as electric arcs, resistance heaters or induction heaters, and these may be used alone or in combination with other forms of heaters. In a powder-type combustion thermal spray gun, a carrier gas, which entrains and transports the powder, can be one of the combustion gases or an inert gas such as nitrogen, or it can be simply compressed air. In a plasma spray gun, the primary plasma gas is generally nitrogen or argon. Hydrogen or helium is usually added to the primary gas. The carrier gas is generally the same as the primary plasma gas.

One form of powder for thermal spraying is composite powder such as disclosed in U.S. Pat. No. 3,617,358 (Dittrich). This patent teaches the use of the spray drying process for making the composites, involving the spraying of a slurry of very fine powdered constituents with a binder to form droplets, and drying the droplets into a powder. There may be only a single constituent, or multiple constituents may be incorporated, for example in a cermet powder of a metal and a non-metal.

Other composite forms are known for thermal spraying, for example metal cladding of a ceramic core as disclosed in U.S. Pat. No. 4,291,089 (Adamovic). According to this patent a clad powder such as nickel alloy clad bentonite is useful for producing thermal sprayed abradable seal coatings for gas turbine engines. Cladding of metal core particles with finer particles of ceramic is taught in U.S. Pat. No. 3,655,425 (Longo and Patel) for similar purpose.

The metal in a composite may have any of a variety of roles, such as to provide a binding function for a non-metal in a coating, or to increase ductility in an otherwise ceramic coating. A further function of the metal may be to provide a melting phase in the thermal spray process so as to carry and bond the non-metal to the coating. This is particularly a requirement for spraying non-metals which are substantially non-meltable, including the bentonite of the above-mentioned patent. Generally, however, conventional composite powders with a high proportion of a non-meltable constituent are difficult to spray and have relatively low deposit efficiency, and some clad powders tend to be costly and difficult to manufacture with consistency. Clad powders are inherently limited in available range of metal to non-metal.

SUMMARY OF THE INVENTION

An object of the present invention is to provide a novel form of composite powder of a metal and a non-metal for the thermal spray process. Another object is to provide improved coatings containing both metal and non-metal, with a wide range of selection of the ratio of metal to non-metal. A further object is to provide such composite powder at reasonable cost and consistency. A particular object is to provide improved thermal spray powders of such materials as bentonite with an alloy binder.

The foregoing and other objects are achieved by a thermal spray powder blend comprising a first constituent powder and a second constitute powder. The constituent powders are in the form of composite particles each of which comprises pluralities of subparticles of metal and non-metal, the latter typically being a ceramic or a polymer. The composite particles of the second powder have a substantially different morphology than the composite particles of the first powder.

In one aspect of the invention the metal in the first powder is present in a first volume percentage based on the total of the metal and the non-metal in the first powder. The metal in the second powder is present in a second volume percentage based on the total of the metal and the non-metal in the second powder. According to the invention the different morphology comprises the first volume percentage of metal being significantly greater than the second volume percentage of metal.

Advantageously the subparticles in at least one of the first and second powders are bonded with organic binder in an amount between about 0.2% and 10% by weight of said one of the powders. In a further aspect of the invention the first and second powders are generally large such as larger than 30 microns, the subparticles of non-metal are generally small such as less than 10 microns. The different morphology comprises subparticles of metal in the first powder being sufficiently large to act as individual core particles with a plurality of subparticles of non-metal bonded thereto, and the subparticles of metal in the second powder being sufficiently small for the second powder to consist essentially of spherical agglomerates of the subparticles.

In a preferred embodiment the non-metal is a calcined siliceous clay such as bentonite, and the metal is a nickel or cobalt alloy.

DETAILED DESCRIPTION OF THE INVENTION

Composite powders of the invention are formed of a metal and a non-metal, for the spraying of coatings containing both constituents. Generally the metal may be any ordinary or desired metal utilized in thermal spraying such as nickel, cobalt, iron, copper, aluminum and alloys thereof, including alloys with each other as well as with other elements.

The metal usually is included to provide a binding function for the non-metal in a coating. The metal also may be used for other purposes such as to increase ductility in an otherwise ceramic coating ("cermet") or to result in a porous metallic layer after a non-metal of polymer or the like has been removed. The metal may be selected according to specific requirements of an application for the coating, for example malleability (e.g. with copper or aluminum), heat transfer or resistance to a corrosive and/or oxidizing environment. In the latter case an alloy may be nickel or cobalt with chromium, aluminum and (in certain situations such as gas turbine engines) a minor proportion of a rare earth metal or oxide of same, such as yttrium, e.g. up to 2% by weight.

A further function of the metal is to provide a melting phase in the thermal spray process so as to carry and bond the non-metal to the coating. This is particularly a requirement for spraying non-metals which are substantially non-meltable, including most of the carbides, borides and nitrides mentioned below. "Non-meltable" as used herein and in the claims generally means having no ordinary melting point or having a characteristic of disassociating or oxidizing in air at elevated temperature, particularly during the short time interval at high temperature in a thermal spray flame or plasma process.

More broadly, the non-metal may be any oxide ceramic utilized for thermal spraying, such as alumina, stabilized zirconia, chromia, titania, and complex oxides of these with each other or other oxides such as magnesia, ceria, yttria and silica. The non-metal alternatively may be a carbide such as a carbide of tungsten, chromium, titanium or zirconium, or a complex carbide of several metals, or a boride, nitride, silicide or the like of any of the foregoing or other metal. An extensive listing of such materials of interest for thermal spraying is disclosed in the aforementioned U.S. Pat. No. 3,617,358. The non-metal also may be a polymer, particularly a high temperature polymer such as a polyimide or aromatic polyester as disclosed in U.S. Pat. No. 3,723,165 (Longo and Durmann).

Many non-metals are difficult to spray because of high melting points, or may be substantially non-meltable as described above. These include many minerals. The present invention is particularly directed to such materials, where it is desired to utilize the metal constituent to carry and bond the non-metal to the coating.

In a preferred embodiment the non-metal is a calcined siliceous clay such as rhyolite or, most preferably, an aluminum silicate clay particularly of the type known as bentonite which contains about 20% alumina, 60% silica, 6-12% water, balance other oxides. Such minerals are of interest for combining with a metal in an abradable type of coating for clearance control in a gas turbine engine, but dissociate rather than readily melt in the thermal spray process.

The composite powder is formed of subparticles in a conventional manner. For example the subparticles may be pressed with or without an organic binder, then sintered, crushed and screened to the desired size. In another method the subparticles may be mixed with an organic binder and blended in a heated pot until the binder is dried and an agglomerated powder is formed, as taught in the aforementioned U.S. Pat. No. 3,655,425.

A particularly useful method of formation of the agglomerated composite powder is with spray drying as described in the aforementioned U.S. Patent No. 3,617,358. In this method an aqueous slurry is formed with the subparticles in a water soluble organic binder, and the slurry is sprayed into droplets which are dried into composite powder particles retained with the binder and classified to size. The binder should be present in an amount between about 0.2% and 10% by weight of the powders. This spray dried powder can be used for thermal spraying as-is since the binder generally burns off in the flame of the spray gun. The powder should have a size distribution generally larger than about 30 microns and up to about 175 microns. The subparticles of non-metal should generally be less than about 10 microns and preferably less than about 5 microns.

If it is necessary to remove the binder, or if denser or less friable or more flowable powder is needed, the spray dried powder may be fired at high temperature. The spray dried powder, with or without the subsequent firing, may further be fed through a hot spray device such as a plasma spray gun as taught in U.S. Pat. Nos. 3,909,241 (Cheny et al.) and 4,773,928 (Houck et al.) to produce a powder that is in a fused form, at least based on fusion of the metal component. Where such fusion is a step, the spray drying step may be replaced with mechanical agglomeration of the constituents as described in U.S. Pat. No. 4,705,560 (Kemp, Jr. et al.).

Excess fusing that may alloy the metal and non-metal together completely into a solution in the powder is not within the purview of the invention. According to the present invention, composite powder of the metal and non-metal subparticles is formed so as to retain the individuality of the metal and non-metal in the powder particles.

Further according to the invention, two separate types of constituent composite powders are produced and blended to form an admixture, in which the composite particles of the second powder have a substantially different morphology than the subparticles of the first powder. In one embodiment of the different morphology, each constituent powder contains pluralities of the metal and non-metal subparticles but in different proportions in the two powders. These proportions are advantageously expressed as volume percentages of the metal based on the total of the metal and the non-metal in the composite powder. Although production of a powder is usually carried out by weighing ingredients, generic use of volume percentages corrects for variations in densities. Conversions are made to volume with known (e.g. handbook) densities of the metal and non-metal (not with bulk densities of the powders).

In this embodiment, in a first constituent powder the metal is present in a first volume percentage, and in a second constituent powder the metal is present in a second volume percentage. The first volume percentage is significantly greater than the second volume percentage. The difference is significant at least in the sense of being more than the ordinary statistical variation in composition of an otherwise homogeneously produced composite powder of the metal and non-metal. Preferably the first volume percentage is at least 10% and preferably at least 25% greater than the second volume percentage. (The 25% or other value is an absolute difference between the first and second percentages rather than a further percent of the original percentages.) Furthermore, the first volume percentage should be greater than 50%, and the second volume percentage should be about equal to or less than 50%.

The difference in percentages is so that one constituent powder will be relatively rich in metal and the other will be relatively lean. The metal-lean powder should contain an amount of metal sufficient, preferably at least 5% by volume, to act as a meltable binder in conveying the non-metal by thermal spraying and bonding same into a coating. The metal-rich powder contributes further to the bonding and cohesion of the coating. The use of the two different constituent powders particularly effects coatings having regions therein that are primarily non-metallic, to take advantage of the non-metallic phase to an extent not always possible in a more homogeneous coating sprayed with a conventional composite powder. Similarly the metal rich regions in the coating should enhance the bonding role of the metal, e.g. by forming a lattice of the metal phase.

In one aspect of the invention the first and second powders have size distributions between about 20 microns and 175 microns, and the subparticles of metal and non-metal in each of the powders are less than about 10 microns. In certain cases it may be desirable for the first and second powders to have different sizes, for example 45 to 75 microns for the first powder and 75 to 150 microns for the second powder, to better distribute the metal about larger regions of non-metal. Although the ingredients of both powders will generally be the same, there also may be cases where either or both the metal and non-metal compositions should be different between the two powders. A further variation is that the two powders in the blend may be produced differently, e.g. the metal-rich powder may be formed of metal core with fine particles of non-metal adhering thereto, and the other powder may be used in the spray dried form. Generally, the conventional production methods suitable for making agglomerated powders have a relatively low cost, particularly compared to the chemical cladding processes.

In a preferred embodiment for the different morphology, the first and second powders are produced from differently sized subparticles, specifically with the metal-rich powder containing coarser metallic subparticles than the metal-lean powder. For example, the first powder (metal-rich) in the blend may have an overall size of 45 to 75 microns and be produced from 5 to 53 micron metal subparticles with a significant fraction such as 50 % greater than 45 microns, and the second powder may have an overall size of 75 to 150 microns and be produced from 5 to 30 micron subparticles. The non-metal constituent in both cases is finer, e.g. less than 10 microns, such as 1 to 5 microns. Because of these relative sizes, the metal lean powder made by spray drying is typical of the process and consists essentially of spheroidal agglomerates of the finer subparticles. However the metal rich powder generally contains relatively large core particles of metal with the very fine non-metal clad and adherent thereto. This clad powder is similar to the ceramic clad powder disclosed in the aforementioned U.S. Pat. No. 3,655,425, and alternatively may be made by the cladding process taught by that patent.

A purpose of coarse size of metal in the metal-rich component is to minimumize oxidation of the metal during the thermal spraying; finer metal particles tend to oxidize more. It was actually found that finer subparticles resulted in coatings that were less resistant to erosion. Conversely the finer subparticles in the metal-lean component are preferred for carrying the non-metallic component, enhancing deposit efficiency and maximizing homogeneity. In this embodiment incorporating differently sized metal subparticles, it may be unnecessary for the second powder to have less alloy content than the first powder, since the different morphology is provided by the difference in alloy subparticle sizes.

Overall in the admixture, a constituent powder should be present in an amount of at least 5% by volume, the exact amount depending on the application and the required proportion of metal to non-metal in the thermal sprayed coating.

Composite powders of the invention are expected to be of use in a variety of different types of applications. For example, wear and/or erosion resistant coatings may be formed using hard materials for the non-metal, such as oxides carbides, borides, nitrides and silicides. Low friction coatings may contain solid lubricant such as molybdenum disulfide, calcium fluoride, graphite, fluorocarbon polymers, cobalt oxide or other such non-metals including those that are substantially non-meltable in the thermal spray process. Abradable clearance control coatings may contain a high temperature plastic, zirconia-based oxide, boron nitride or siliceous clay. Blade tips for a gas turbine may be coated with an abrasive phase such as hard alumina, carbide, boride or diamond particles.

The following are by way of example and not limitation.

EXAMPLE 1

Alloy powders of nickel with 6% chromium and 6% aluminum were thoroughly mixed with a calcined bentonite powder of 1 to 5 microns in two different proportions to form two different mixtures. The first mixture was made with 5 to 80 micron alloy powder (with 50 % greater than 46 microns and 17.5 percent by weight bentonite, and the other was with 5 to 30 micron alloy powder and 50% by weight bentonite. A water slurry was formed with each mixture, to which was added 5% by weight sodium carboxymethyl cellulose binder based on solids content, and 2% Nopcosperse (TM) suspension agent. Each slurry was spray dried conventionally in the manner disclosed in the aforementioned U.S. Pat. No. 3,617,358. Using densities of 8.4 g/cc and 2.6 g/cc respectively for the nickel alloy and the bentonite (the latter density being based on aluminum silicate), volume ratios for alloy to bentonite were about 60:40 for the first powder and 25:77 for the second powder; thus the volume percentage is 35% greater in the first powder.

The first powder (nickel rich) was classified to −75 +44 microns and had a bulk (powder) density of 2.0 g/cc. The second powder (nickel lean) was classified to −150 +75 microns and had a bulk density of 0.8 g/cc. The two powders were blended as constituents to form a powder blend, in proportions 90 % by weight of the first powder and 10 % of the second powder.

The blended powder was thermal sprayed with a Metco Type 6P gun sold by The Perkin-Elmer Corporation, with the following parameters: nozzle 7A-M, oxygen/acetylene pressures 2.8/1.0 kg/cc and flows 45/28 1/min (standard), spray rate 3.8 kg/hr, and spray distance 22 cm.

Comparisons were made with a clad thermal spray powder of similar bentonite and nickel alloy composition of the type described in U.S. Pat. No. 4,291,089 and sold as Metco 312 by Perkin-Elmer. This clad powder has been accepted into use in gas turbine engines as an abradable clearance control coating for temperatures up to about 850° C. Results are shown in Table 1.

TABLE 1

| | Blend (1) | Clad (2) | |
|---|---|---|---|
| Deposit Efficiency | 85% | 65% | |
| Hardness (15 Y) | 74 | 62 | |
| Relative Erosion Rate - Perpendicular Impingement (coating volume loss) | 0.8 | 1.0 | |
| Relative Erosion Rate - Low Angle (20°) Impingement | 0.94 | 1.0 | As Sprayed |
| | 0.72 | 1.0 | Oxidized |

TABLE 1-continued

| | Blend (1) | Clad (2) |
|---|---|---|
| (coating volume loss) | | 77 hrs @770° C. |

(1) This Invention (Example 1)
(2) Metco 312 (Prior art)

Despite the higher hardness and lower erosion rates, coatings sprayed with the powder blend also has displayed similar abradability to the clad powder coatings. Neither coating showed significant wear of titanium turbine blade tips.

Metallurgically, the alloy rich phase showed melting to form the coating matrix while the bentonite constituent became entrapped in the matrix, very similarly to Metco 312 coatings.

EXAMPLE 2

Example 1 was repeated using 22.5% by weight bentonite (in place of 50 %) in the formation of the second powder. The volume ratios for alloy to bentonite were about 60:40 for the first powder (the same as Example 1) and about 50:50 for the second powder. Coatings with similar properties were obtained but with improved bond strength due to the higher alloy content. In this blend the two constituent powders have similar bulk densities so as to minimize segregation of powders.

EXAMPLE 3

Example 1 is repeated with the additional manufacturing step of feeding the powder through a Metco Type 10MB plasma gun to fuse the alloy phase. The collected powder has significantly higher bulk density and flowability. Coatings are very similar to those of Example 1.

EXAMPLE 4

Example 1 is repeated using an alumina-silicate clay with a higher proportion of alumina, in place of bentonite. The alumina is 45% vs 2% for bentonite. Similar deposit efficiency, hardness, metallurgy and are obtained.

EXAMPLE 5

Two powders are prepared by spray drying fine powdered ingredients of a chromium-molybdenum steel and molybdenum disulfide. In the first powder the metal is 75 volume percent, and in the second powder the metal is 25 volume percent. The blend is formed with 80 weight percent of the first powder in 44 to 74 microns and 20 weight percent of the second powder in 74 to 149 microns. The blend is sprayed with the thermal spray gun used for Example 1. A wear resistant coating is obtained which is self-lubricating.

EXAMPLE 6

Two powders are prepared by spray drying fine powder ingredients of type 316 stainless steel and silicon carbide. In the first powder the metal is 65 volume percent, and in the second powder the metal is 35 volume percent. The blend is formed with 75 weight percent of the first powder 44 to 120 microns and 25 weight percent of the second powder 74 to 150 microns. The blend is sprayed with a conventional plasma spray gun using parameters for stainless steel. A coating is obtained that is abrasive and useful for honing.

EXAMPLE 7

Example 6 is repeated with the steel replaced with nickel-chromium-aluminum-yttrium alloy, and the silicon carbide replaced with aluminum oxide. The abrasive coating is useful for turbine blade tips rubbing against a clearance control coating of zirconia stabilized with yttria.

EXAMPLE 8

Two powders are prepared by spray drying fine powdered ingredients of nickel-chromium-aluminum-yttrium alloy and zirconia stabilized with yttria. In the first powder the metal is 85 volume percent, and in the second powder the metal is 15 volume percent. The blend is formed with 85 weight percent of the first powder 44 to 106 microns and 15 weight percent of the second powder 63 to 175 microns. The blend is sprayed with a conventional plasma spray gun to form a high temperature abradable clearance control coating.

EXAMPLE 9

Two powders are prepared by spray drying fine cobalt-chromium alloy powders with molydisilicide. In the first powder the metal is 60 volume percent, and in the second powder the metal is 20%. The blend is formed with 75 weight percent of the first powder 44 to 105 microns and 25 weight percent of the second powder 74 to 88 microns. The blend is sprayed with a conventional plasma spray gun using standard parameters for cobalt based powders. A coating is obtained that is used for high temperature tribological applications, such as shafts in chemical applications.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray powder blend comprising a first constituent powder and a second constituent powder, the constituent powders being in the form of composite particles each of which comprises subparticles of metal and non-metal, wherein the metal in the first powder is present in a first volume percentage based on the total of the metal and the non-metal in the first powder, the metal in the second powder is present in a second volume percentage of at least 5% based on the total of the metal and the non-metal in the second powder, and the first volume percentage has an absolute difference over the second volume percentage of at least 25%.

2. The powder blend according to claim 1 wherein the first volume percentage is greater than 50% and the second volume percentage is between about 5% and 50%.

3. The powder blend according to claim 1 wherein the metal is the same in the first powder and the second powder, and the non-metal is the same in the first powder and the second powder.

4. The powder blend according to claim 1 wherein the metal is selected from the group consisting of nickel, cobalt, iron, copper, aluminum, and alloys thereof.

5. The powder blend according to claim 1 wherein the non-metal is selected from the group consisting of ceramics and polymers.

6. The powder blend according to claim 5 wherein the non-metal is substantially non-meltable.

7. The powder blend according to claim 6 wherein the non-metal is further selected from the group consisting of carbides, borides, nitrides and silicides.

8. The powder blend according to claim 6 wherein the non-metal is an oxide.

9. The powder blend according to claim 8 wherein the oxide is a calcined silicious clay.

10. The powder blend according to claim 9 wherein the clay is an aluminum silicate clay.

11. The powder blend according to claim 10 wherein the metal is an alloy of nickel or cobalt.

12. The powder blend according to claim 1 wherein the subparticles in at least one of the first and second powders are bonded with organic binder in an amount between about 0.2% and 10% by weight of said at least one of the powders.

13. The powder blend according to claim 12 wherein the subparticles of non-metal are less than 10 microns, the subparticles of metal in the first powder are between 45 and 75 microns so that the subparticles of metal in the first powder act as individual core particles with a plurality of subparticles of non-metal bonded thereto, and the subparticles of metal in the second powder are between 5 and 30 microns so that the second powder consists essentially of spherical agglomerates of the subparticles.

14. The powder blend according to claim 13 wherein the subparticles of metal in the first powder include a fraction of at least 50% of the subparticles that are larger than 45 microns, and the subparticles of metal in the second powder are less than 30 microns.

15. The powder blend according to claim 14 wherein the first powder has a size from about 45 to 75 microns the second powder has a size from about 75 to 150 microns.

16. The powder blend of claim 15 wherein the metal is an alloy of nickel with chromium and aluminum, and the non-metal is bentonite.

* * * * *